US011054107B2

(12) United States Patent
Henrici et al.

(10) Patent No.: US 11,054,107 B2
(45) Date of Patent: Jul. 6, 2021

(54) OPTICALLY EFFECTIVE COVER FOR A LIGHT SOURCE

(71) Applicant: BJB GmbH & Co. KG, Arnsberg (DE)

(72) Inventors: Philipp Henrici, Arnsberg (DE); Olaf Baumeister, Sundern (DE); André Hering, Amsberg (DE)

(73) Assignee: BJB GmbH & Co. KG, Arnsberg (DE)

( * ) Notice: Subject to any disclaimer, the term of this patent is extended or adjusted under 35 U.S.C. 154(b) by 0 days.

(21) Appl. No.: 17/110,473

(22) Filed: Dec. 3, 2020

(65) Prior Publication Data

US 2021/0172580 A1 Jun. 10, 2021

(30) Foreign Application Priority Data

Dec. 5, 2019 (DE) ..... 102019133240.0

(51) Int. Cl.
*F21V 5/00* (2018.01)
*F21Y 105/18* (2016.01)
*F21Y 115/10* (2016.01)

(52) U.S. Cl.
CPC ..... *F21V 5/007* (2013.01); *F21Y 2105/18* (2016.08); *F21Y 2115/10* (2016.08)

(58) Field of Classification Search
CPC ..... F21V 5/007
USPC ..... 362/555
See application file for complete search history.

(56) References Cited

U.S. PATENT DOCUMENTS

| | | | | |
|---|---|---|---|---|
| 6,402,347 | B1 * | 6/2002 | Maas | F21V 5/04 362/294 |
| 8,641,230 | B1 | 2/2014 | Jiang | |
| 10,551,028 | B2 * | 2/2020 | Joergensen | F21V 5/007 |
| 10,837,619 | B2 * | 11/2020 | Jiang | F21V 5/008 |
| 2004/0130891 | A1 * | 7/2004 | Twardawski | B62J 6/02 362/157 |
| 2010/0061090 | A1 * | 3/2010 | Bergman | G02B 27/30 362/231 |
| 2010/0073957 | A1 * | 3/2010 | Mills | A61C 19/004 362/555 |

(Continued)

FOREIGN PATENT DOCUMENTS

| | | |
|---|---|---|
| DE | 102005011110 | 10/2005 |
| DE | 102010014209 | 10/2011 |

(Continued)

*Primary Examiner* — Bryon T Gyllstrom
(74) *Attorney, Agent, or Firm* — Von Rohrscheidt Patents

(57) ABSTRACT

A cover for a light source of a light configured to influence illumination characteristics of light of the light source that is configured in particular as one or plural LEDs, the cover comprising a light entry side that is oriented towards the light source; primary optics arranged on the light entry side of the cover and configured to orient the light for an exit from the cover; a light exit side that is oriented away from the light source; and a structured outer surface portion on the light exit side of the cover, wherein structuring elements of the outer surface portion form secondary optics that correct a light exit from the cover, wherein the secondary optics respectively have convex cambered surfaces, wherein the structured outer surface portion is formed by plural secondary optics, wherein the convex cambered surfaces of the secondary optics are arranged directly adjacent to one another.

7 Claims, 4 Drawing Sheets

(56) References Cited

U.S. PATENT DOCUMENTS

| | | | | |
|---|---|---|---|---|
| 2011/0063836 | A1* | 3/2011 | Salm | F21V 7/0091 362/235 |
| 2012/0002424 | A1 | 1/2012 | Cho | |
| 2014/0334149 | A1* | 11/2014 | Nolan | F21K 9/60 362/235 |
| 2015/0009669 | A1* | 1/2015 | Gervais | G02B 3/0056 362/244 |
| 2019/0331314 | A1* | 10/2019 | Engelen | G02B 19/0066 |

FOREIGN PATENT DOCUMENTS

| | | | |
|---|---|---|---|
| DE | 102012021163 | | 5/2014 |
| WO | WO2013154098 | A1 | 10/2011 |
| WO | WO2014/184422 | A1 | 11/2014 |
| WO | WO2012144325 | A1 | 11/2014 |

* cited by examiner

OPTICALLY EFFECTIVE COVER FOR A LIGHT SOURCE

RELATED APPLICATIONS

This application claims priority from and incorporates by reference German Patent Application DE 10 2019 133 240.0 filed on Dec. 5, 2019.

FIELD OF THE INVENTION

The invention relates to a cover for a light source of a light or lamp.

BACKGROUND OF THE INVENTION

Covers of this type are generally designated as optics due to their property of influencing e.g. controlling the light that exits from a light source.

A cover or optics of this generic type are disclosed in WO2014/184422. The cover or optics include a light entry side and a light exit side. The light entry side includes primary optics that adjust the light that exits from the light source with respect to its radiation characteristics and in particular influence an exit direction of the light from the cover. The primary optics that are provided on the light entry side typically collimate the light emitted by the light source. It rarely happens that the optical structures provided on the light entry side are used to scatter the light.

An outer surface portion of the cover illustrated in WO2014/184422 forms several frustrum shaped elements in addition to a lens shaped central portion on a light exit side wherein the frustrum shaped elements function as secondary optics and are offset from one another with flat surface portions there between. The secondary optics are distributed in concentric rings about the center lens shaped portion and help in particular to reduce scatter light.

The scatter light that exits from the cover causes two undesirable effects. On the one hand side the scatter light blinds persons that look towards the light source furthermore, the light refraction causes undesirable color fringes or color deviations on radiated surfaces.

Problematic scatter light radiation is generated in particular in portions of the cover where primary optics are provided on the light entry side by geometric structures. This is the reason why WO2014/184422 includes the secondary optics shaped as substantial frustrum shaped objects in particular in outer surface portions on the light exit side that correspond with the primary optics.

However, it has become evident that the structures that are used in this document as secondary optics are insufficient to reliably prevent the blinding as well as the color fringes.

BRIEF SUMMARY OF THE INVENTION

Thus, it is an object of the invention to provide an optically effective outer surface of the light exit side for generic covers wherein the optically effective outer surface effectively counteracts the generation of color fringes and/or blinding scatter light radiation.

Thus the object is achieved by A cover for a light source of a light configured to influence radiation characteristics of light of the light source that is configured in particular as one or plural LEDs, the cover comprising a light entry side that is oriented towards the light source; primary optics arranged on the light entry side of the cover and configured to orient the light for an exit from the cover; a light exit side that is oriented away from the light source; and a structured outer surface portion on the light exit side of the cover, wherein structuring elements of the outer surface portion form secondary optics that correct a light exit from the cover, wherein the secondary optics respectively have convex cambered surfaces, wherein the structured outer surface portion is formed by plural secondary optics, wherein the convex cambered surfaces of the secondary optics are arranged directly adjacent to one another.

The essential advantage of the cover according to the invention is that flat surface portions on the light exit side between the secondary optics that form the structured outer surface portion and reduce the scatter light are lacking. Thus, there is no surface portion in the structured outer surface portion of the cover that is not covered by secondary optics. Eventually the scatter light that blinds and generates color fringes is almost completely prevented.

In a particularly advantageous embodiment, each of the secondary optics is formed by a cap or half of an ellipsoid, an ovoid or of a sphere, in particular when the secondary optics of the structured outer surface portion are identical.

In a particularly advantageous embodiment, the geometric elements are arranged so that centers of three adjacent secondary optics form corners (vertices) of a triangle.

It is furthermore provided that a cross sectional surface of the respective cap has a polygonal base shape which causes a polygonal outer contour of the cap in a portion of an edge of the cross-sectional surface.

In an advantageous embodiment, each secondary optic (17) is a spherical cap with a spherical radius R and a hexagonal sectional surface, wherein centers of the hexagonal sectional surfaces of three adjacent spherical caps form an equilateral triangle with a height B and a lateral length A.

An advantageous embodiment provides that the radius R has a size of 1.5 mm. The radius can be up to 30% smaller or up to 30% larger than 1.5 mm.

Advantageously the lateral length A has a dimension of 0.52 mm wherein this can be varied in a range of −30% to +30%. The triangle height B has a dimension 0.6 mm, wherein this dimension can be varied in a range of −30% to +30%, wherein each percentile dimension change of the lateral length A causes a corresponding dimensional change of the triangle height B by the same absolute value.

Overall, a radius R of 1.5 mm facilitates performing a variation of the lateral length A and the triangle height B by +/−30% without substantially degrading advantageous effects of the invention. Additionally, also the radius of 1.5 mm can be implemented up to 30% larger or up to 30% smaller.

BRIEF DESCRIPTION OF THE DRAWINGS

The invention is now described in more detail based on an embodiment with reference to drawing figures wherein.

DETAILED DESCRIPTION OF THE INVENTION

Figure 1:
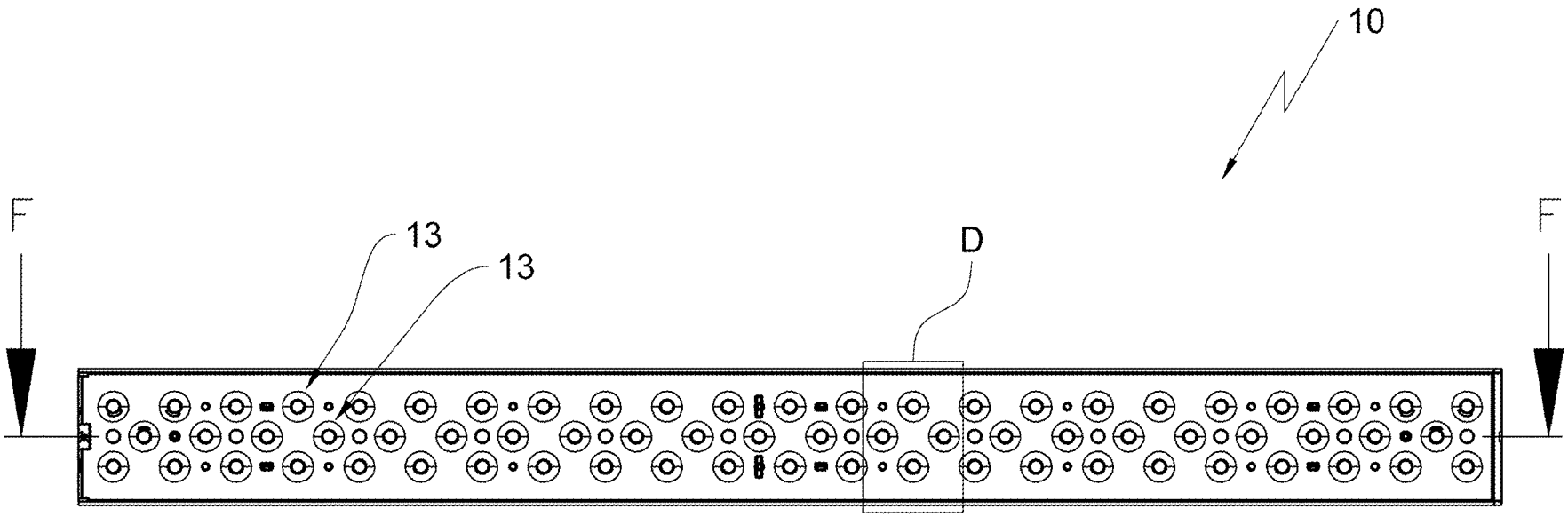
FIG. 1 illustrates a cover according to the invention in a top view.

In the drawing figures the cover according to the invention is designated overall with reference numeral 10.

The cover 10 is illustrated in FIG. 1 in a top view, thus looking at the light exit side 11 which is a side of the cover 10 that is oriented away from a light source. For reasons of clarity structured outer surface portions are not illustrated in FIG. 1. The cover 10 is made from a translucent material, in particular from a translucent synthetic material and therefore the primary optics 13 arranged on the light entry side 12 are shown clearly. The light entry side 12 is the side of the cover 10 that is oriented towards the light source.

Figure 2:
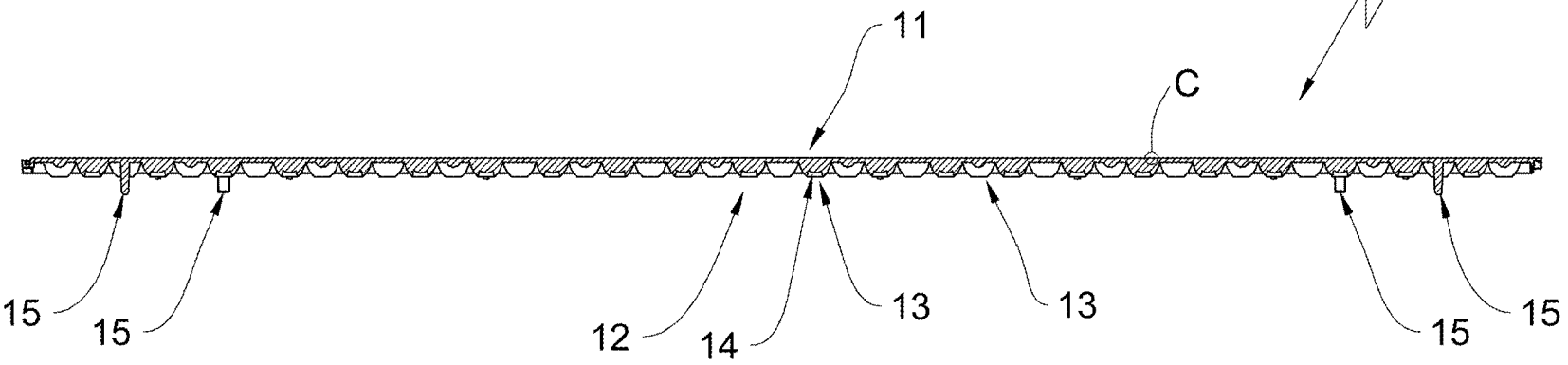
FIG. 2 illustrates a sectional view of the cover according to the invention along a sectional line F-F in FIG. 1.

As evident from FIG. 2, the sectional view according to sectional line F-F in FIG. 1, the primary optics are formed by the cover itself and in particular integrally formed in one piece by an injection molding process. Part of the primary optics illustrated in FIG. 2 is shown in a sectional view. Thus, it is evident that each of the primary optics 13 includes a recess 14 in which LEDs of a light source are inserted. Since the primary optics cover the LEDs light exits from the LEDs laterally past the primary optics are reduced to an absolute minimum.

This way it is assured that almost all light emitted by the light source or the LED functioning as the light source is collected by the primary optics and oriented to exit from the cover in a desired orientation. Thus, light refracting or light focusing structures like lenses or prisms are formed in the primary optics depending on the effect to be achieved. It is appreciated, however, that suitable optical structures are selected for the primary optics 13 depending on the desired radiation effect on the light exit side 11 of the cover 10.

Furthermore, attachment and/or centering devices are formed on the light exit side of the cover 10. These devices facilitate orienting the cover 10 relative to a circuit board that is configured with light sources, in particular LEDs and the cover 10 is attached at the circuit board or at an additional lamp component.

Figure 4:
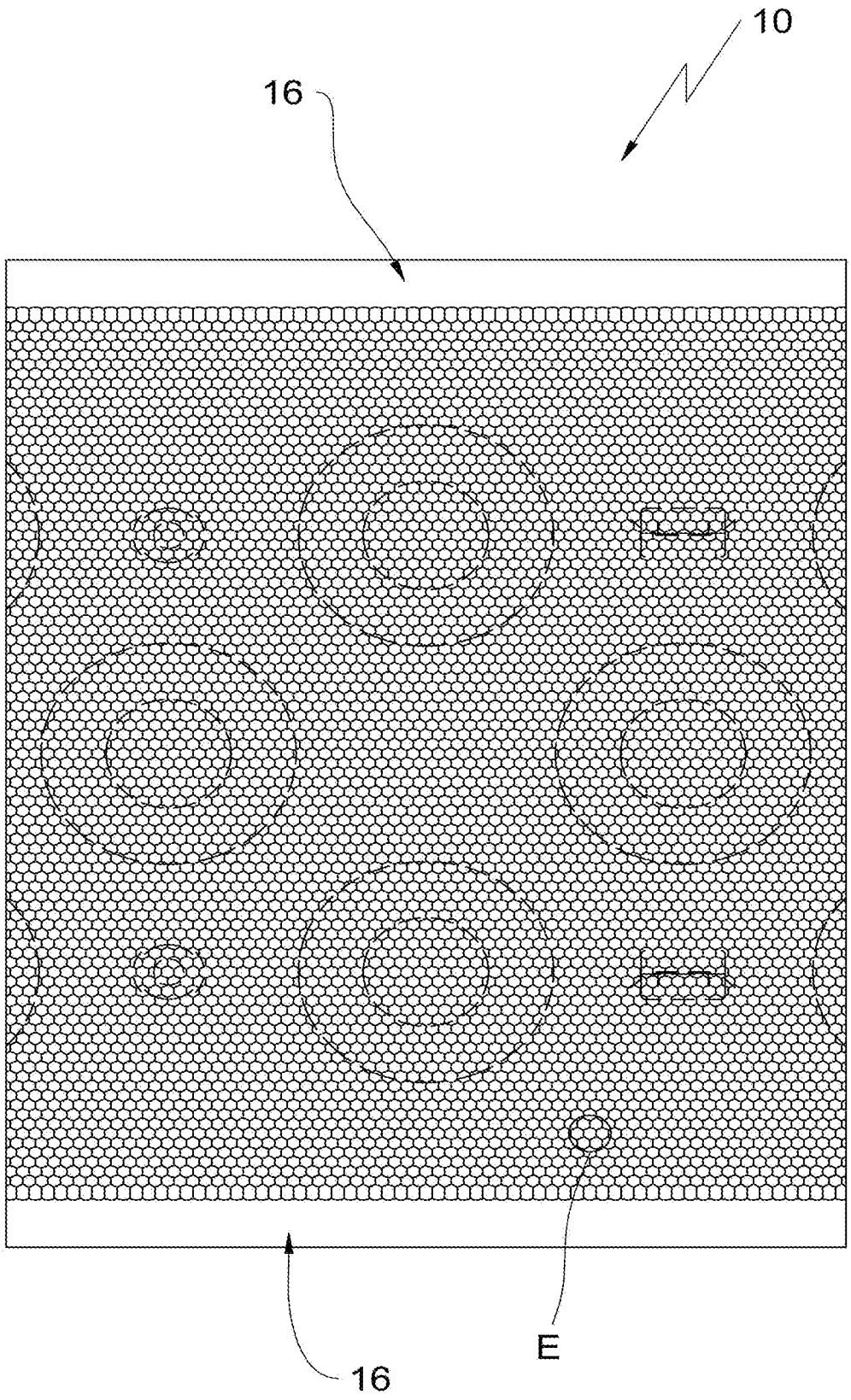
FIG. 4 illustrates a detail view according to detail D in FIG. 1.

FIG. 4 illustrates detail D of FIG. 1. This is in turn a view of the light exit side 11 of the cover 10, Differently from FIG. 1, the structured outer surface of the cover 10 is illustrated in FIG. 4.

On the illustrated cover 10 the entire outer surface of the light exit side 11 is provided with a structure with exception of an edge portion 16. However, it is quite sufficient for other applications when the subsequently described structure is only formed in the portion of the primary optics 13 on the light exit side 11.

Figure 3:
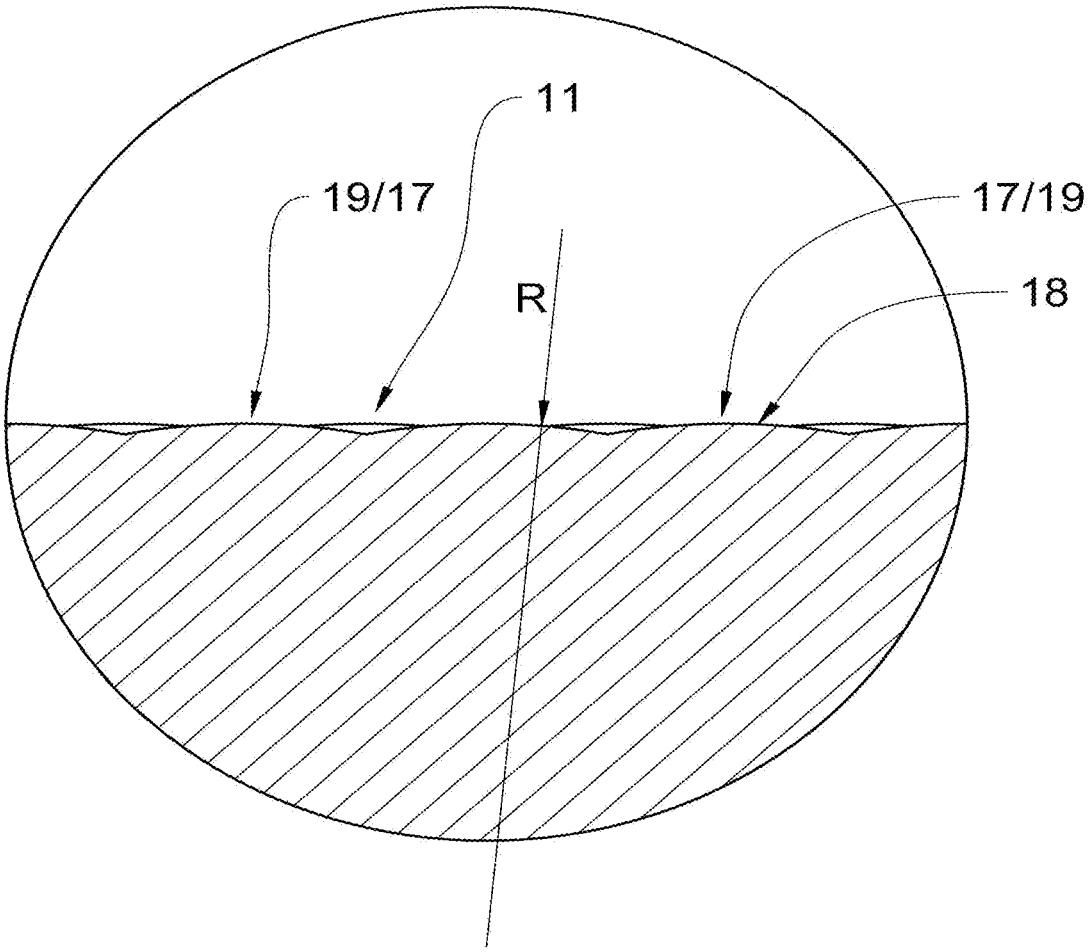
FIG. 3 illustrates a detail view according to detail circle C in FIG. 2.
Figure 5:
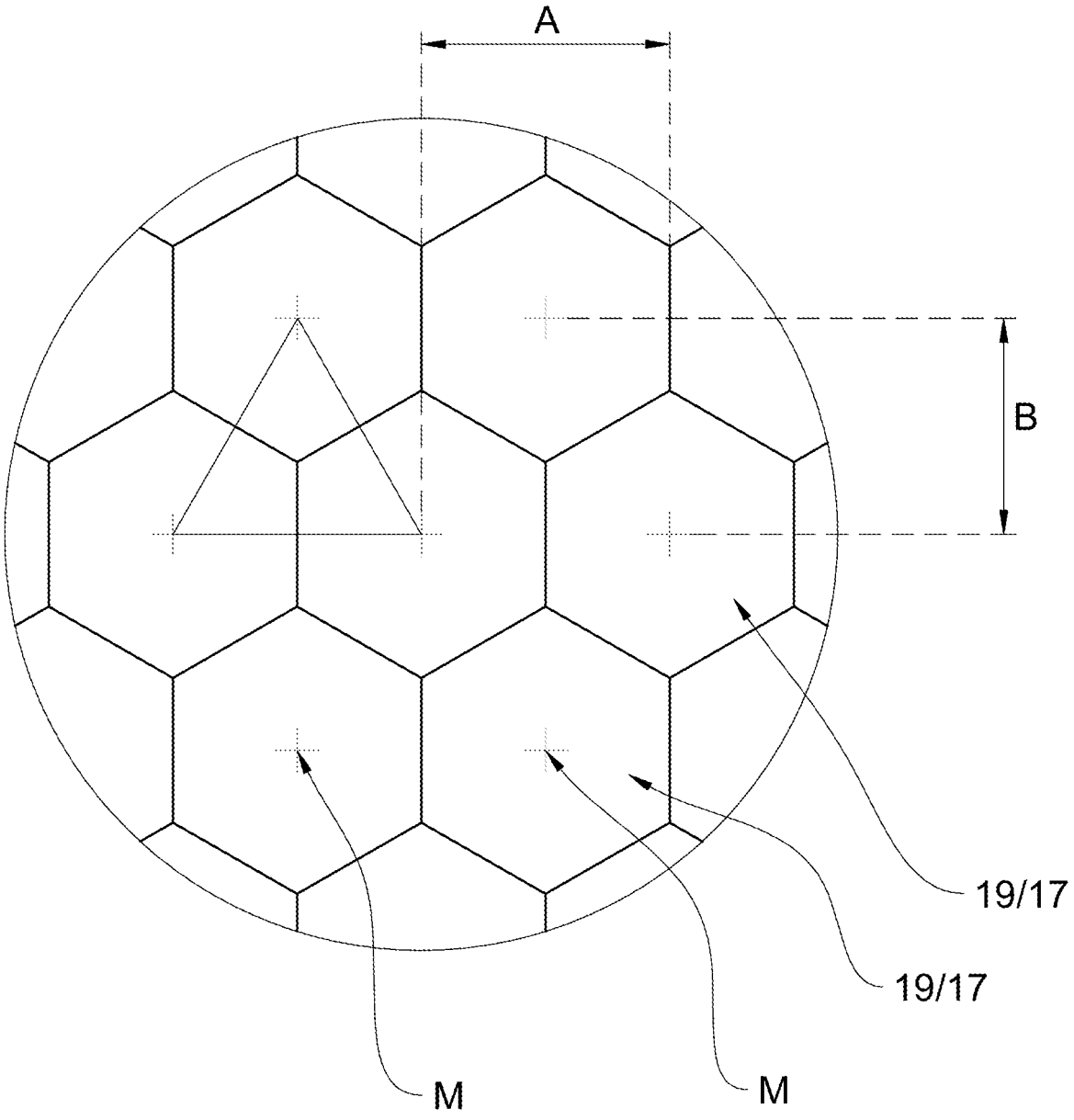
FIG. 5 illustrates a detail view according to detail circle E in FIG. 4.

In the instant case, the structure is an essentially honeycomb shaped structure made from individual geometric elements. Thus, FIG. 5 illustrates a view according to the detail circle E in FIG. 4. FIG. 3 illustrates a detail view according to detail circle C in FIG. 2.

In this embodiment the structure is formed by a plurality of secondary optics 17 that respectively include a convex cambered optically effective surface 18. The secondary optics are spherical caps or culottes 19. The secondary optics are spherical caps or spherical culottes 19 that are arranged directly adjacent to each other, Flat surface portions between secondary optics 17 are intentionally avoided. This way there is no surface portion without influencing secondary optics 17 in a portion of the structured outer surface of the light exit side 11 besides the edge portion 16.

Structuring the edge portions 16 is optional since no light emitted from the light sources exits from the edge portions 16 in the instant embodiment.

FIG. 5. shows that sectional surfaces of the spherical caps 19 are configured hexagonal and therefore outer contours of the spherical caps 19 that are arranged adjacent to each other also have hexagonal shapes. This honeycomb shape advantageously avoids portions without secondary optics on the light exit side 11 of the cover 10.

A highest protrusion of each of the secondary optics 17 forms a pole or apex point of each spherical cap 19 vertically above the center M of the hexagonal surface. Each center M or pole M of each of the secondary optics 17 is marked by a cross in FIG. 5.

The poles M of three adjacent secondary optics 17 form the corners (vertices) of an equilateral triangle with a side length A and a height B. The side length A also corresponds to the distance of two opposite hexagon sides. The triangle height B also corresponds to the distance of two diametrically opposed hexagon corners (vertices).

In an exemplary embodiment, the side length A is 0.6 mm, the triangle height B is 0.52 mm, and the spherical radius is 1.5 mm.

At a spherical radius of 1.5 mm a triangle height B of 0.52 mm and a side length A of 0.6 mm provides the best result. Varying the value of A and B within +/−30%, however, is acceptable and achieves desired results. Therefore the values of the side length A can vary can be between 0.36 mm and 0.68 mm and the values of the triangle height B can vary between 0.42 mm and 0.78 mm. Thus, a percentile increase or reduction in the value A also causes the value B to change by the percentage. Put another way, A/B is a constant (0.52/0.60) irrespective of any percentile change in A from 0.6 mm.

The secondary optics 17 that form the structured outer surfaces of the light exit side 11 of the cover 10 provide impart a final adjustment to the light exiting from the light exit side 11 that has been pre-oriented by the primary optics 13. The cover according to the invention significantly reduces color fringes and blinding scatter light.

Different configurations of the secondary optics 17, e.g. ellipsoid caps or ovoid caps or other contours of the sectional surfaces are suited to achieve the advantageous effects of the invention.

REFERENCE NUMERALS AND DESIGNATIONS

10 cover
11 light exit side
12 light entry side
13 primary optics
14 recess
15 attachment and/or centering device
16 edge portion
17 secondary optics
18 convex surface
19 spherical cap/spherical calotte
A side length
B triangle height
R radius
M center/pole

What is claimed is:

1. A cover for a light source of a light or lamp configured to adjust radiation characteristics of light of the light source that is configured as one or plural LEDs, the cover comprising:

a light entry side oriented towards the light source;

primary optics arranged on the light entry side of the cover that adjust light entering into the cover;

a light exit side oriented away from the light source; and a structured outer surface portion on the light exit side of the cover, wherein structuring elements of the structured outer surface portion form secondary optics that adjust light exiting from the cover, wherein the structured outer surface portion is formed by plural secondary optics, wherein the plural secondary optics have convex cambered surfaces, wherein the convex cambered surfaces of the secondary optics are arranged adjacent to one another, wherein a respective entirety of each of the plural secondary optics is formed by a single individual respective cap of an ellipsoid, an ovoid, or a sphere, wherein a planform of each single individual respective cap is polygonal, and wherein the planform of each single individual respective cap abuts to planforms of other single individual respective caps directly in straight circumferential lines.

2. The cover according to claim 1, wherein the plural secondary optics of the structured outer surface portion are identical.

3. The cover according to claim 1, wherein centers of three adjacent secondary optics form vertices of a triangle.

4. The cover according to claim 1, wherein the plural secondary optics are formed respectively by a spherical cap with a spherical radius and a hexagonal planform, and wherein centers of hexagonal planforms of three adjacent spherical caps form an equilateral triangle with a height and a side length.

5. The cover according to claim 4, wherein the spherical radius is 1.5 mm 30%.

6. The cover according to claim 5, wherein the side length is 0.52 mm+/−30%, wherein the triangle height is 0.6 mm+/−30%, and wherein a percentile change of the side length and a percentile change of the triangle height are the same.

7. The cover according to claim 1, wherein there are no flat surface portions between the plural secondary optics.

* * * * *